US006388553B1

(12) United States Patent
Shea et al.

(10) Patent No.: US 6,388,553 B1
(45) Date of Patent: May 14, 2002

(54) CONDUCTIVE POLYMER CURRENT-LIMITING FUSE

(75) Inventors: John J. Shea; William K. Hanna, both of Pittsburgh, PA (US)

(73) Assignee: Eaton Corproation, Cleveland, OH (US)

( * ) Notice: Subject to any disclaimer, the term of this patent is extended or adjusted under 35 U.S.C. 154(b) by 0 days.

(21) Appl. No.: 09/517,169

(22) Filed: Mar. 2, 2000

(51) Int. Cl.[7] ..... H01H 85/06; H01H 85/143; H01C 8/04

(52) U.S. Cl. ..... 337/167; 337/190; 337/187; 338/22 R; 338/224

(58) Field of Search ..... 337/167, 190, 337/186, 187, 228; 338/22 R, 204, 223–225

(56) References Cited

U.S. PATENT DOCUMENTS

| | | | | |
|---|---|---|---|---|
| 3,886,401 A | * | 5/1975 | Berg | 315/94 |
| 3,914,727 A | | 10/1975 | Fabricius | |
| 3,916,264 A | * | 10/1975 | Berg | 317/41 |
| 5,142,265 A | * | 8/1992 | Motoyoshi et al. | 338/22 R |
| 5,382,938 A | | 1/1995 | Hasson et al. | |
| 5,565,826 A | | 10/1996 | Karlström | |
| 5,614,881 A | | 3/1997 | Duggal et al. | |
| 5,644,283 A | * | 7/1997 | Grosse-Wilde et al. | 338/20 |
| 5,667,711 A | * | 9/1997 | Mody et al. | 219/505 |
| 5,844,467 A | | 12/1998 | Shea | |
| 5,920,251 A | * | 7/1999 | Shea | 337/140 |
| 5,969,928 A | * | 10/1999 | Hashimoto et al. | 361/106 |
| 6,157,286 A | * | 12/2000 | Ranjan et al. | 337/35 |

FOREIGN PATENT DOCUMENTS

JP 7-322445 * 12/1995 ..... H02G/03/16

OTHER PUBLICATIONS

Moffatt, D. et al., "V203 Composite Thermistors," IEEE, pp. 673–676, 1986.

"Installation and Maintenance of Current Limiter Type PROLIM," Instruction 1 SFB 1–17, 2 pp., Oct. 1992.

Raychem Corporation, "PolySwitch® Devices Standard Product List," Product List 2 pp., Feb. 1993.

Tomas Hansson, "Polyethylene Current Limiters for Short–Circuit Protection," New Current Limiter, Brochure SK 97—901E, Apr. 1992.

"Motor Starter Protection with PROLIM—the Complete Solution," Pamphlet DK 97–102 E, Edition 1, 6 pp., May 1992.

"There are Lots of Novelties and Sensations, but Only a Few Innovations," Brochure SK 97–101E, 4 pp., Feb. 1992.

* cited by examiner

*Primary Examiner*—Anatoly Vortman
(74) *Attorney, Agent, or Firm*—Martin J. Moran

(57) ABSTRACT

Conductive polymer current-limiting fuses. when connected in series with conventional mechanical circuit breakers, exhibit extremely low let-through values. Particularly, conductive polymer current-limiting fuses based on conductive elastomeric material are disclosed which exhibit extremely low let-through values, namely less than 5,000 $A^2s$ with a switch current of 1.79 $kA_p$, preferably less than 2,500 $A^2s$, most preferably no more than 2,250 $A^2s$.

5 Claims, 5 Drawing Sheets

CONDUCTIVE POLYMER CURRENT-LIMITING FUSE

FIELD OF THE INVENTION

This invention relates to current-limiting fuses containing a conductive polymer exhibiting a sharp increase in electrical resistance at a threshold current. The polymer is coupled in series with mechanical breaker contacts and is resistively heated to the threshold temperature in the event of a fault current, to limit current as the breaker opens. A commutation shunt resistance can be coupled in parallel with the polymer. The invention relates to conductive polymer current-limiting fuses which exhibit extremely low let-through values. More particularly, the conductive polymer current-limiting fuses are based on metal-filled elastomer material and exhibit let-through values less than 5,000 $A^2s$ with a switch current of 1.79 $kA_p$, preferably less than 2,500 $A^2s$, most preferably no more than 2,250 $A^2s$. Several embodiments are disclosed, including an arrangement is which at least one electrode is in free surface contact with a planar polymer element and urged against the polymer element under a force.

BACKGROUND INFORMATION

For protecting circuits and loads as well as persons and property, electrical energy advantageously must be controlled nearly instantaneously to react to a sensed fault condition. For example, it is advisable promptly to disengage a load in the event of a short circuit or similar fault condition by cutting off the current supply. If the fault current is not quickly cut off, the potential for serious damage is increased. For this reason, short-circuit protection devices are routinely incorporated in power supply circuits for controllably interrupting a fault current. A circuit protective device may sense and respond to long term current overload, or to a ground fault or a short circuit. In the event of a short circuit. the protective device should operate as quickly as possible.

Devices for controlling current involve one or more means along a current supply conductor, in series with the load, which insert an insulating gap or large resistance when triggered. These include mechanically separable electrical contacts, fuses, thermistors with positive temperature coefficients and others. Elastomers for use in such devices are comprised of all polymers that exhibit elastic properties which are similar to those exhibited by natural rubber. Elastomers can be compressed or stretched within a relatively large permitted elastic area, and return to their original state when the load is removed. Electrically conductive elastomers are a class of rubber and plastics which have been made electrically conductive, either by the addition of metal mixtures or by orienting metal fibers under the influence of electric fields, or by the addition of different carbon mixtures or ceramics, for instance V2O3-material dispersed in the manner described in the article "V2O3 Composite Thermistors" by D. Loffat, et al, published in Proceedings of the Sixth IEEE International Symposium on Applications of Ferroelectrics, 1986, pages 673–676. In rubber, there is used several types of "carbon black", for instance graphite, acetylene black, lampblack and furnace black with particle diameters ranging from 10–300 nm. Examples of appropriate rubber materials which become electrically conductive after adding metal mixtures or carbon mixtures are butyl, natural, polychloroprene, neoprene, EPDM, and the most important silicone rubber. Additives of metals and metal alloys in powder form suited as elastomer additives are silver, nickel, copper, silver-plated copper, silver-plated nickel, and silver-plated aluminum.

The most common types of carbon or metal-filled plastics are polyethylene and polypropylene. These are used at present for heating cables and for overload protectors, for instance the earlier mentioned polymer-based PTC-thermnistors. However, an electrically conductive filler impairs the mechanical properties of the plastic. The material becomes brittle and hard and is therewith not readily deformed. These materials are therefore less useful as pressure transducers with pressure contacts. A further limitation of carbon-filled plastics resides in their relatively high resistivity, typically one 1 Ohm cm and higher, which limits applications to low power. On the other hand, metal-filled plastics can be produced with significantly lower resistivity, lower than 0.5 Ohm cm, although voltage or tension stability becomes very poor, and consequently these materials are not suited as overload protectors.

Electrically conductive elastomers can be given very low resistances, for instance resistances of 2 mOhm cm or lower, by admixing metal powder. One advantage afforded by elastomers is that they are very soft in comparison with carbon-filled polyethylene and polypropylene, even when containing large quantities of electrically conductive filler. Such elastomers will have a typical Shore number of between 20–80, according American Standard ASTM D2240 (Q/C).

To function as a current limiting element includes at least one electrically conductive elastomeric body and two electrodes. The polymer composition of the elastomeric body may be of various kinds, examples of suitable elastomers including butyl, natural, polychlorpropylene, neoprene, EPDM and silicone rubber. The electroconductive powder material is preferably comprised of silver, nickel, cobalt, silver-plated copper, silver-plated nickel, silver-plated aluminum, lampblack, conductive soot or carbon black. The powder material will suitably have a particle size of 0.01–10 micro-meters and the powder filler is suitably present in an amount corresponding to 40–90% of the combined weight of the powder filler and elastomeric material. The resistivity of the electric elastomeric body will preferably lie within the range of 0.1 mOhm cm–10 Ohm cm. When the device includes more than one electrically conductive elastomeric body, the bodies may be made of mutually the same or mutually different elastomers and then with mutually the same or mutually different fillers and resistivity. The electrodes are of a conventional kind, for instance silver-plated copper. The electrodes are preferably oriented so that repulsion forces will occur between the electrodes when high currents pass therethrough. The pressure achieved on the electrodes, for instance with a known pressure device described in U.S. Pat. No. 3,914,727, or by a conventional spring mechanism for the on/off function of an electric switch, deforms the convex abutment surface of the elastomeric body, when the device includes such an abutment surface. This deformation will preferably reach at least 5%. A deformation of 5–30% is particularly preferred, as defined with a starting point from the distance between the bodies that borders on a considered elastomeric body, i.e. if the distance when the pressure is 0 and bordering bodies lie in abutment with the elastomeric body is d and if the distance changes to 0.7.multidot.d after the pressure has been applied, the body will have been deformed by 30%. Particularly preferred elastomeric bodies are those which have a hardness between 30–50 IRHD in accord with British Standard BS903/A26, although materials having both a lower and a higher hardness may conceivably be used.

Mechanical circuit breakers have the capacity to interrupt high currents.

However, the break-time of conventional circuit breakers is several milliseconds, with even the fastest circuit breakers taking 3 to 5 ms to open and interrupt fault currents. Due to various mechanical constraints and the continuation of conduction as an are is struck and extinguished between the separating contacts, traditional circuit-breaker technology leaves little potential for further reductions in break-times.

SUMMARY OF THE INVENTION

The present invention provides a compact, low cost, high power fuse, based on conductive polymers designed to be connected in series with a conventional mechanical circuit breaker. The combination is believed suitable for use at Type II protection levels, i.e., no damage to contactor contacts in a motor starter combination at high fault ratings. When combined with a conventional mechanical circuit breaker, the devices of the invention exhibit extremely low let-through values, preferably less than 5,000 $A^2$s. more preferably less than 2,500 $A^2$s, most preferably no more than 2,250 $A^2$s, with a typical switch current of 1.79 $kA_p$, wherein the switch current is the current at which the device of the present invention rapidly transitions to a high resistance state.

The invention provides a high power fuse capable of increasing the current limiting capacity of mechanical circuit breakers when connected in electrical series therewith, by inserting a series resistance upon the occurrence of a fault current at which the mechanical circuit breaker will throw.

According to an aspect of the invention, a fuse is provided with a metal filled elastomer, two electrodes, a spring, enclosure, and a commutation shunt device. The metal filled elastomer is held in contact with a pair of electrodes through the application of a force sufficient to deform the elastomer at the interface with the electrodes, resulting in a low device resistance.

According to another aspect of the invention, a fuse is provided whose resistance increases at a threshold current, at which point a dielectric barrier forms between the metal particles in the elastomer and the electrodes, increasing sharply the resistance of the fuse, whereupon the current is commutated into a shunt impedance in parallel with the elastomer.

The fuse of the invention may be combined with a conventional circuit breaker for use at Type II protection levels, that is. at voltages up to 480 V and current up to 100 kA. The fuses exhibit fast sharp and well controlled switching characteristics.

According to one embodiment, the fuse comprises a body of an electrically conductive elastomer, wherein the body defines two parallel surfaces. At least two electrodes bear against the body for carrying current. At least one of these electrodes is in free contact with one of the parallel surfaces and a pressure mechanism maintains a force perpendicular to the parallel surfaces to mechanically force the electrodes against the parallel surfaces. A shunt resistor is provided in parallel with the electrodes and the body.

In accordance with the present invention, fuses are provided which comprise a body of an elastomeric composition rendered electrically conductive by a conductive filler. The composition comprises an elastomer selected from silicone rubber, Kraton® thermoplastic rubber compounds, thermoplastic elastomer (TPE) compounds, ethylene-propylene-diene monomer (EPDM), gum rubbers and the like; and a plurality of conductive particles selected from silver, nickel, aluminum, iron, copper, carbon black and mixtures thereof.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the spirit and scope of the appended claims.

DETAILED DESCRIPTION

The various features and advantages of the invention may be more readily understood with reference to the following detailed description taken in conjunction with the accompanying drawings, in which the same reference numbers have been used throughout to identify corresponding elements.

Figure 1:
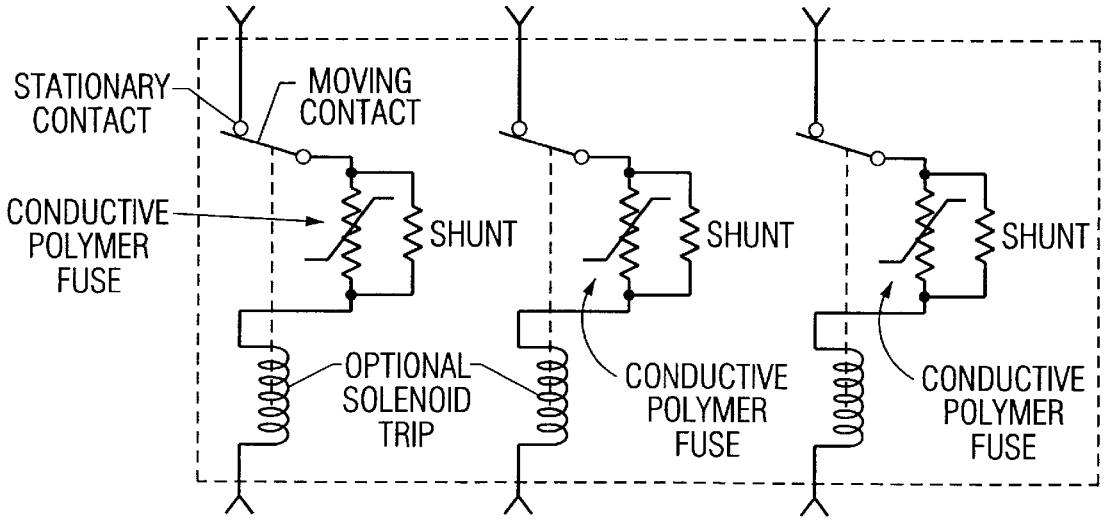
FIG. 1 is a schematic diagram showing a three-phase circuit breaker employing the conductive polymer element of the invention.

Referring to FIG. 1, a compact, low cost, high power conductive polymer fuse of the present invention is employed in series with separable stationary and moving contacts of a circuit breaker for increasing the current limiting capacity of the circuit breaker 12 by very rapidly inserting a resistance in series with the contacts during a fault Such as a short circuit. The fuse comprises a current limiting material including an elastomer that is rendered conductive by a conductive filler, between two electrodes having in parallel a commutation shunt resistor. The current limiting material preferably comprises from about 5 to about 50 weight percent elastomer, and from about 50 to about 95 weight percent conductive particles. More preferably, the current limiting material comprises from about 15 to about 30 weight percent elastomer, and from about 70 to about 85 weight percent conductive particles. The current limiting material preferably have a durometer (shore A scale) of from about 10 to about 200, more preferably from about 50 to about 100.

In steady state use, the resistance of the elastomer element is low, and dissipation of any resistive heating is fast enough to overcome any temperature rise. Fuse operation occurs when the current exceeds a threshold at which resistive heating exceeds dissipation and the temperature of the element rises above a threshold switching temperature. In the case of a short circuit fault, this Occurs very rapidly, for example in a few tenths of a millisecond. The series resistance of the clement increases sharply and current is commutated into the parallel shunt. A temporary dielectric barrier forms between the metal particles in the elastomer and the electrode which allows for voltage holdoff. After a recovery period, the fuse resistance is approximately ten times higher than the original value.

Type II protection levels at 480 V/100 kA are possible when the fuse is used in series with a circuit breaker having means to sense a short circuit fault and to drive an electromechanical device for separating the breaker contacts. Such a breaker typically operates in about four milliseconds, and the elastomer element of the invention provides a limitation on current in the interim. Additional advantages of the invention as compared to conventional fuses such as sand filled fuses is its small size and low threshold current.

The elastomeric element is in series with the circuit breaker contacts (and the load) and can be either externally or internally mounted in the circuit breaker casing. The device can be used to obtain type II UL classification for motor starter protectors or can be used only with a circuit breaker to increase the interruption ratings of the breaker. The device must be utilized with some form of opening switch in series, such as a circuit breaker, to provide full circuit isolation and to prevent the fuse from overheating.

Preferably, the elastomer main fuse element is a silver filled elastomer, preferably packaged as shown in FIGS. 2 through 5 between copper electrodes. The element is mounted such that a force is applied to the conductive polymer, which can be disk shaped, by the electrodes. At least one of the electrodes. and preferably both, is in simple surface abutment with its facing electrode. Sufficient force is applied to deform the elastomer against the electrode. The force determines the resistance of the device. with higher force producing lower contact resistance and lower device resistance. Proper operation during the transition also depends on the extent of force. Excessively high force can result in electrical breakdown and failure of the fuse during transition. The optimal force is in the range of 1 lb. to 50 lbs. depending on the surface area in contact with the polymer. The pressure would range from 1 PSI to 500 PSI with the optimal range being 50 PSI to 200 PSI. Optimal force depends on the conductive polymer thickness; the desired device resistance and the desired current threshold value that causes switching.

Figure 2:
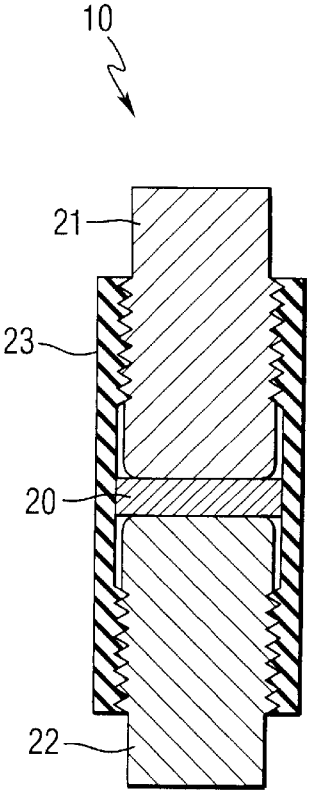
FIG. 2 is a cross sectional illustration of a first embodiment of the conductive elastomeric element.

In FIG. 2, the electrodes 21 and 22 are threaded into an electrically insulated casing tube 23 from opposite ends and compress the elastomer element 20 between them, the extent of force being a function of the torque exerted when threading the electrodes into the tube.

Figure 3:
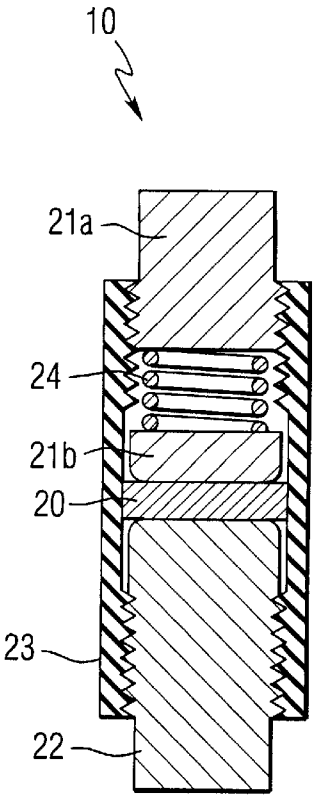

In FIG. 3, one of the electrodes comprises a stub 21*a* and a contact disk 21*b*, and a helical compression spring 24 urges the contact disk 21*b* against the elastomer element 20. The pressure exerted is determined by the position of the electrode stub, the selection of spring constant, and the electrode surface area. The electrical connection between the stub 21*a* and the disk 21*b* can be made through the spring 24.

Figure 4:
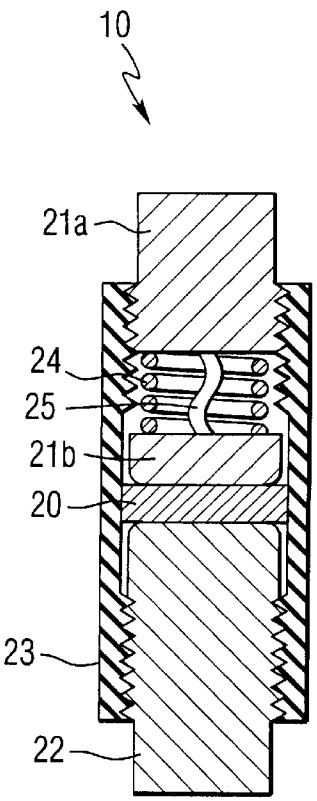

Preferably, however, a flexible conductor 25 is coupled between the stub 21*a* and the contact disk 21*b* as shown in FIG. 4 to make the electrical connection. An insulator (not shown) can be provided on one or both ends of the spring 24 such that no current passes through the spring 24, which would lead to thermal expansion and an increase in pressure in a fault current condition. Other forms of springs are also possible, such as a Belleville spring washer or lock washer.

Figure 5:
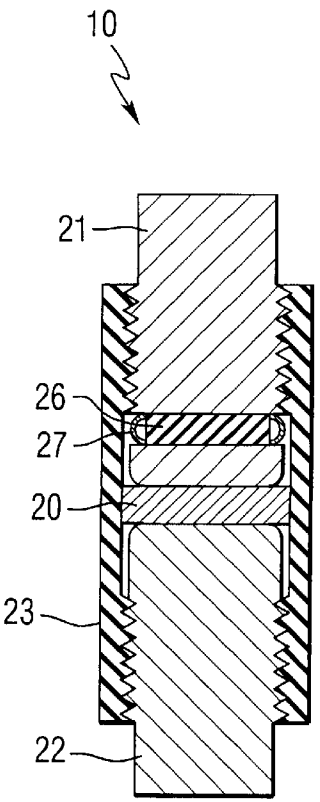
FIGS. 3, 4 and 5 are cross sections of alternative embodiments.

In FIG. 5, the function of the spring is served and an electrical connection is made by a flexible copper disk 27, for example having a thickness of 0.003 to 0.020 inches, by which the stub 21*a* urges the contact disk 21*b* against the elastomer 20. A silicone rubber disk 26 may optionally be located inside the copper disk 27.

The electrodes 21 and 22 are preferably silver or nickel plated copper. The plating prevents a detrimental increase in resistance of the device over a long period of time. The dimensions of the electrodes 21 and 22 and the elastomer disk 20 can be, for example, 0.375 inch in diameter. The edges of the contact disc 21*b* or the electrodes 21 and 22 in contact with the elastomer 20 are preferably radiused to avoid localized field stress on the polymeric elastomer. The elastomer disk 20 can be, for example, about 0.065 inches thick. The tube 23 could be made from glass, thermoset polyester, epoxy, micarta, or thermoplastic.

The design shown in FIG. 2 uses the elastomeric qualities of the conductive RTV silicone rubber to provide low contact resistance and the necessary resiliency during switching. The hardness of the conductive polymer and the type of polymer may limit this design. Additional pressure relief may be necessary as shown in FIGS. 3, 4 and 5. This will allow for the addition of a coil spring to increase the resiliency of the electrode/polymer interface. The shape of the conductive elastomer can be preferably flat. This invention does not require special shaping of the polymer unlike previous designs, for example, the design disclosed in U.S. Pat. No. 5,565,826 to Karlstrom. Current is conducted through the spring in this ease. An addition to this design, FIG. 4, is the flexible copper braid attached between the electrode in contact with the conductive polymer and the upper copper electrode. This minimizes the current flow through the coil spring. An insulator added between the spring and the upper electrode will totally prevent current flow in the spring. FIG. 5 shows the coil spring replaced by a piece of silicone rubber. The rubber acts like a spring. The rubber should have a shore hardness of approximately durnometer 40. A flexible solid copper connection is made between the electrode and the upper electrode. The copper would have a thickness in the range of 0.003 inch to 0.020 inch depending on the steady state current rating.

The elastomer 20 and the contact surfaces of the electrodes 21 and 22 and any contact disk 21*b* can be hermetically sealed in the casing tube 23 to prevent oxidation of either the metal filled elastomer or the electrode and disk contact surfaces. Additionally, an inert gas can be used to fill the tube 23 and displace any oxygen. This effectively prevents oxidation of the critical parts of the device. Silver is a preferred conductive material, however, hermetic sealing with an inert gas allows the choice of lower cost conductive filler materials and materials subject to oxidation, such as nickel, aluminum, iron, or copper particles.

In one embodiment the elastomer comprises commercially available conductive RTV silicone rubber, available from Norlabs, Inc. under the designation. Flat disks of this material are made by placing the uncured paste into a Teflon mold to produce a disk shaped part. The material is air dried at room temperature for 24 hours and then cut to fit the device. The part is cut so as to provide a seal against the inner wall of the tube, effectively filling a space separating the two electrodes. Other types of conductive elastomers could be used such as other types of silicones or thermoplastic elastomers such as silicone rubber, Kraton® thermoplastic rubber compounds, thermoplastic elastomer TPE compounds, EPDM, gum rubbers, etc.

Conductive particles in the commercially available mixture consist of silver particles, preferably of various sizes. Other conductive particles can be used such as nickel, aluminum, iron, or copper, or mixtures of said particles. A mix of particle sizes is advantageous for obtaining the desired low resistivity mixture. Particle size can range between 1 $\mu$m to 500 $\mu$m, preferably 10 $\mu$m to 200 $\mu$m and most preferred in the 30 $\mu$m to 80 $\mu$m range.

A commutation shunt may be necessary for proper operation of the fuse depending on the application. Circuits with low power factors would require a shunt. Highly resistive circuits do not require a commutation shunt. The shunt prevents dielectric breakdown of the transition interface by commutating the residual current from the interface. This prevents ohmic heating at the interface which can lead to dielectric breakdown. Shunt values can range from 0.050 Ω to 1 Ω with the preferred values ranging from 0.1 Ω to 0.4 Ω and most preferred in the range of 0.15 Ω to 0.25 Ω. These values also depend on the intended circuit application and the opening time of the circuit breaker. Typically, the breaker will open and clear within a half cycle. Many types of current-limiting breakers will typically clear in 3 ms to 5 ms. The shunt is sized according to the circuit voltage and the clearing time. A sufficient cross-sectional area is necessary so that the shunt does not melt during, its operation.

For example, the shunt may be a ribbon shunt having a low inductance such that the switching voltage across the body of electrically conductive, elastomeric composition, incorporated in parallel with the ribbon shunt in the fuse, can be minimized. Specifically, the ribbon shunt may comprise a flat sheet of conductive material of desired resistivity folded over onto itself to provide the desired inductance of less than 200 μH.

The ribbon shunt material should be selected from the group of conductive materials having a resistance in the range of 0.05 Ω to 100 Ω, preferably 0.05 Ω to2 Ω, most preferably 0.1 Ω. Furthermore, the selected material must possess a resistivity of 10 μΩ cm to 500 μΩ cm, preferably 100 μΩ cm. The ribbon shunt material should be selected from a group of conductive materials having a resistivity in the range of 50 μΩ cm to 1,400 Ω cm, melting points above 1,000° C. and generally high specific heats. Potential candidate materials which meet these requirements are listed in Table 1. Generally, materials which are malleable and low in cost with high melting temperatures and which have high resistivity are preferred. Those skilled in the art will know to choose the appropriate shunt material to obtain the desired shunt resistance in the range of 0.05 Ω to 10 Ω, preferably 0.1 Ω to 2 Ω and most preferred 0.1 Ω in a reasonable shunt volume.

TABLE 1

| MATERIAL | RESISTIVITY (μΩ cm) | MELTING POINT (° C.) |
|---|---|---|
| Metallic Glasses | | |
| Co 66/Si 15/B 14/Fe 4/Ni 1 | 142 | N/A |
| Co 70/Si + B 23/Mn 5/Fe + Mo 2 | 130 | N/A |
| Fe 40/Ni 38/B 18/Mo 4 | 138 | N/A |
| Iron/Boron/Silicon | 124 | N/A |
| Ni 78/B 14/Si 8 | 90 | N/A |
| Invar | | |
| Fe 64/Ni 36 | 80 | N/A |
| Aluchrom O | 140 | 1520 |
| Fecralloy Iron/Chromium | 134 | 1380–1490 |
| Chromaloy O (Fe 75/Cr 20/Al 5) | | |
| Stainless Steel 302 | 71 | 1400–1420 |
| Stainless Steel 304 | 71 | 1400–1455 |
| Stainless Steel 310 | 70–78 | 1400–1455 |
| Stainless Steel 316 | 70–78 | 1370–1400 |
| Stainless Steel 321 | 70–73 | 1400–1425 |
| Stainless Steel 347 | 70–73 | 1400–1425 |
| Stainless Steel 410 | 56–72 | 1480–1530 |
| Stainless Steel 15-7PH | 80 | |
| Stainless Steel 17-7PH | 80–85 | 1435 |
| Incoloy 800 | 93–100 | 1350–1420 |
| Iconel 718 | 125 | 1260–1335 |
| Iconel 600 | 103 | 1370–1425 |

TABLE 1-continued

| MATERIAL | RESISTIVITY (μΩ cm) | MELTING POINT (° C.) |
|---|---|---|
| Iconel X | 123 | 1390–1425 |
| Shaped Memory Alloy (Ni/Ti) | 100 Austinite | 1310 |
| Hastelloy C | 125–130 | 1270–1390 |
| Hastelloy B | 137 | 1340–1390 |
| Waspaloy | 120–130 | 1340–1390 |
| Evanohm | 134 | 1340–1390 |
| Nichrome V (Ni 80/Cr 20) | 108 | 1400 |
| Chromel | 71 | 1420 |
| Ti 90/Al 6/V 4 | 168 | 1600–1650 |
| Carbon Paper | 1375 | 3650 |
| Manganese | 160 | 1244 |
| Iron | 10 | 1535 |

The ribbon shunt should be sized to withstand the energy it could be exposed to during a fault current condition while also providing the desired resistance. The maximum energy absorption capacity limit for a given ribbon shunt material may be taken as the melting point of said material as calculated using equation number (1):

$$Q = \int_{t_s}^{t_1} i^2 R\,dt = C_p \Delta T \delta v = C_p \Delta T \delta A l \tag{1}$$

wherein Q is the maximum energy absorption capacity, v is the volume of the shunt. i is the instantaneous current through the shunt, t is the time the current is flowing in the shunt, t, is the time where transition occurs, t, is the time at which the current through the shunt ceases, $\Delta T = T_{melting} - T_{ambient}$, $T_{melting}$ is the melting point temperature for the shunt material, $T_{ambient}$ is the ambient temperature, $C_p$ is the specific heat capacity of the shunt material, δ is the density of the shunt material, A is the cross sectional area of the shunt, and 1 is the length of the shunt material. The cross-sectional area, length and type of the material used for the ribbon shunt will affect the resistance thereof according to equation (2):

$$R = \rho \frac{l}{A} \tag{2}$$

wherein R is the resistance, ρ is the resistivity, 1 is the length of the shunt and A is the cross-sectional area of the shunt. One skilled in the art would know to use equation (1) and equation (2) to determine the appropriate combination of shunt cross-sectional area and length for a given shunt material to provide a ribbon shunt with an adequate withstand strength and resistance for a given application.

The ribbon shunt is preferably coated with an electrically insulating material, i.e. kapton tape, and then folded over onto itself in a geometry that provides an inductance of less than 400 μH, preferably less than 190 μH. Table 2 lists the inductance at 60 Hz of different geometries using a ribbon shunt made from a sheet of 304 stainless steel that was 2 inches wide, 0.002 inch thick and 18 inches long. Table 2 also lists the inductance for two different geometries using, a wire shunt for comparison purposes.

TABLE 2

Effect of Geometry on Ribbon Shunt Inductance

| Geometry | Inductance at 60 Hz (nH) |
|---|---|
| Flat Sheet | 394 |
| U-Shaped | 319 |
| Serpentine | 280 |
| S-Shaped | 190 |
| Circular | 168 |
| S-Shaped Wire | 1200 |
| Straight Wire | 1300 |

The actual geometry chosen will likely be determined by the packaging volume available. The minimum inductance should be chosen for a given geometry. This can be determined experimentally. In general, the wider the ribbon shunt the lower the inductance. Folding the ribbon onto itself may be needed to fit into the available space. The folds must be insulated to prevent shorting out the shunt. Appropriate insulation must be capable of withstanding the voltage and the temperature of the metal during a fault current condition. Suitable insulation can include, but is not limited to, the following: woven glass fiber, polyimide (e.g., KAPTON), ceramic paper, fishpaper, Teflon, glass filled melamine, polyesters and epoxies.

Figure 6:
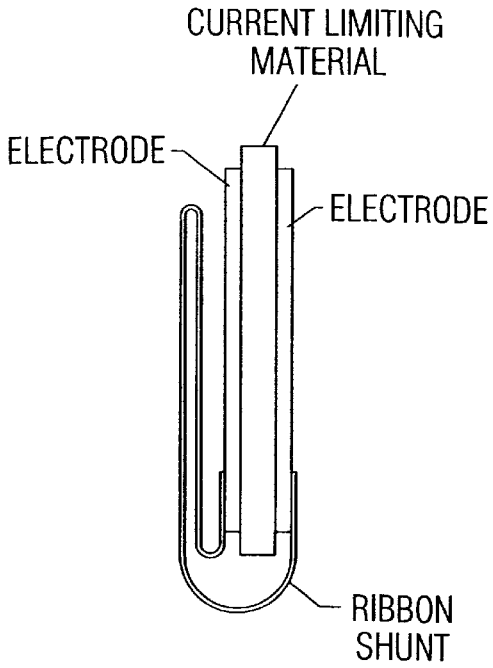
FIGS. 6 and 7 are elevation views showing alternative embodiments of the element with shunt.
Figure 7:
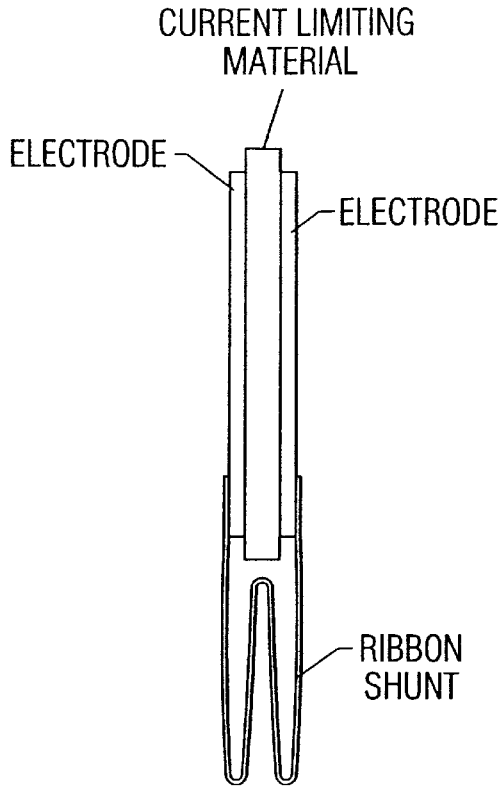
Figure 8:
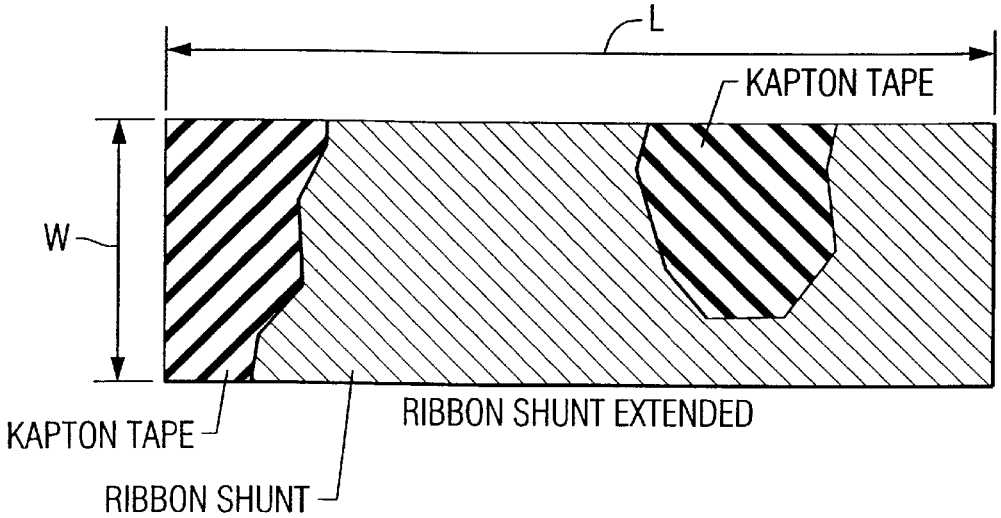
FIG. 8 is a partly sectional view of a shunt in the form of a ribbon.
Figure 9:
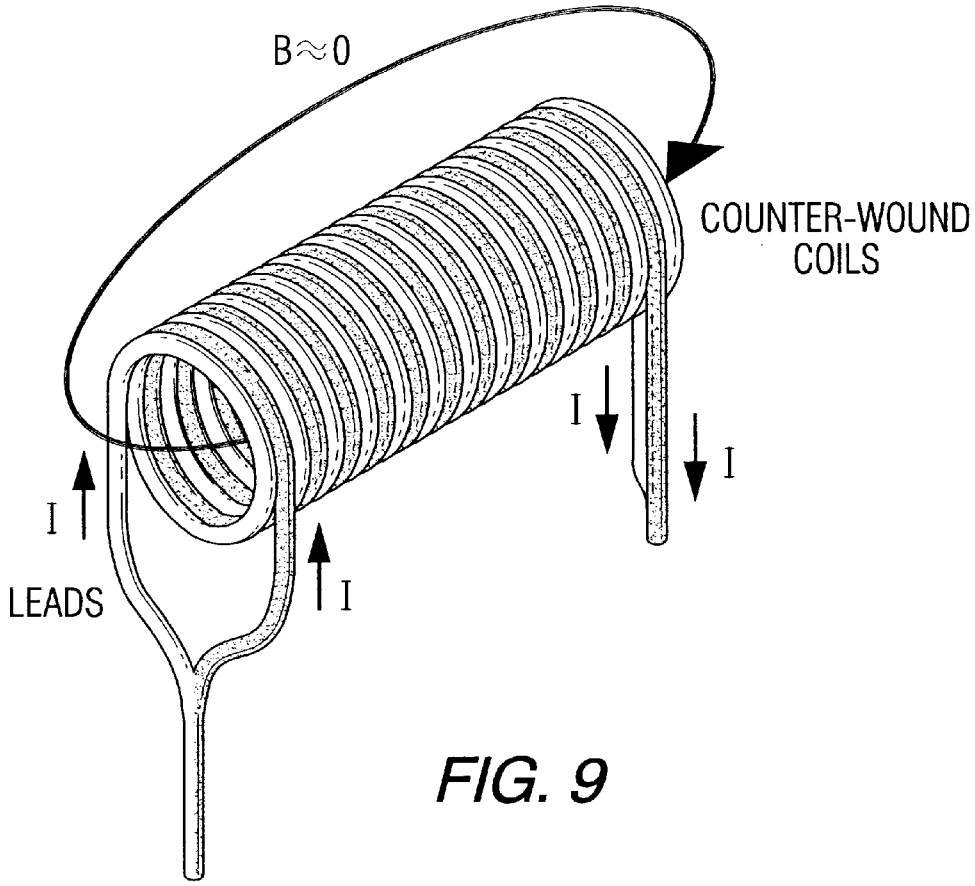
FIG. 9 is a perspective view of an alternative shunt having counter-wound coils.
Figure 10:
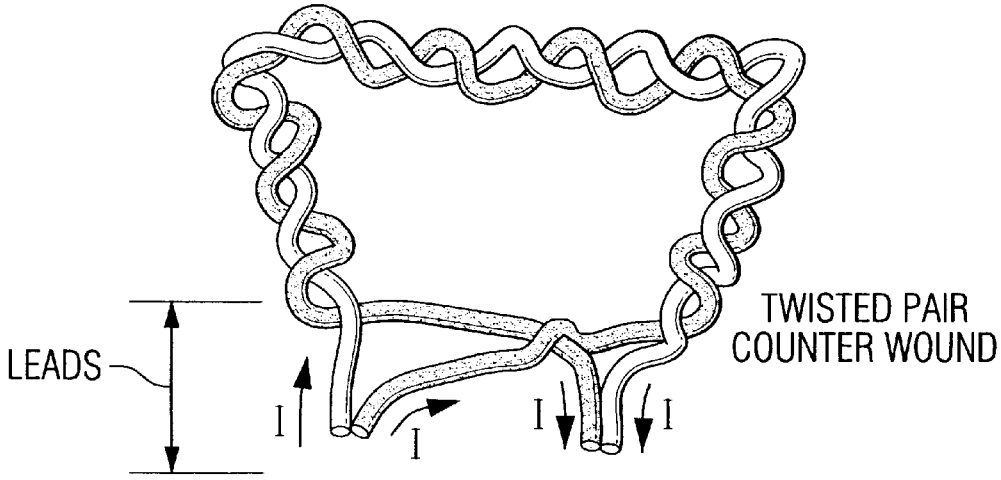
FIG. 10 is an elevation view of an alternative shunt having a twisted pair conductor.

Two possible configurations for the ribbon shunt are described in U.S. Pat. No. 5,844,467, which is incorporated herein by reference, and are shown in FIGS. 6 and 7. A top cross-sectional view of a ribbon shunt 31 for use with the invention is shown in FIG. 8. Alternative designs for the shunt consisting of counter wound wires are shown in FIGS. 9 and 10. This design allows the use of wires rather than a ribbon shunt. The design may be either a cylindrical coil design as shown in FIG. 9 or a twisted wire pair design as shown in FIG. 10. The inductance of one coil of wire cancels the inductance of the other coil. In order for this design to be effective the lead length, i.e. the length of uncoiled or untwisted wire, must be kept as short as possible, i.e., less than 1 inch, preferably less than 0.5 inch, and the wires should be kept as close as physically possible. The wires must be insulated from each other. Appropriate insulation must be capable of withstanding the voltage and the temperature of the wire during a fault current condition. Suitable insulation includes. but is not limited to, woven glass fiber, KAPTON®, ceramic paper, fishpaper, glass filled melamine, Teflon polyesters, and epoxies. The desired shunt resistance remains the same as previously stated. Thus, the resistance of each coil or wire needs to be double the desired shunt resistance.

The invention will now he illustrated by the following Example, which is intended to be purely exemplary and not limiting in any way.

EXAMPLE

A prototype laboratory device was made in the following manner. An uncured metal fillet RTV silicone elastomer was used to make a flat one inch diameter 0.065 inch thick disk of conductive elastomer. A section measuring 0.5 inch×0.75 inch×0.065 inch was cut from the disk and placed against a flat copper electrode (0.375 inch wide×1 inch long×0.020 inch thick) in a fixture with a threadably adjustable screw for setting the pressure on the elastomer. The other electrode consisted of a ⅜ inch diameter 0.5 inch long copper slug with a blunt nose radius on the end contacting the elastomer. A polyethylene rod, 0.25 inch diameter×0.5 inch long, was placed between the copper slug and a bolt used to apply pressure to the elastomer. The bolt was adjusted to provide the desired electrical resistance (approximately 3 mOhm) between the copper slug and the flat electrode. Electrical connections were made between the flat copper electrode and a second piece of 0.020 inch thick copper strip (318 inch width×1 inch length) which was placed between the polyethylene rod and the copper slug used to make an electrical connection.

Figure 11:
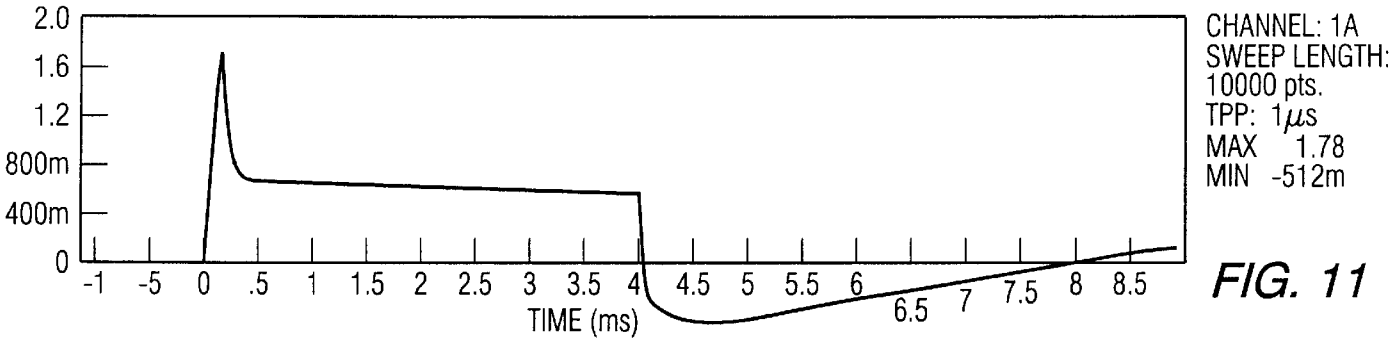
FIGS. 11, 12 and 13 are time plots illustrating the current, voltage and power characteristics, respectively, of a circuit breaker employing the element and a shunt resistor.
Figure 12:
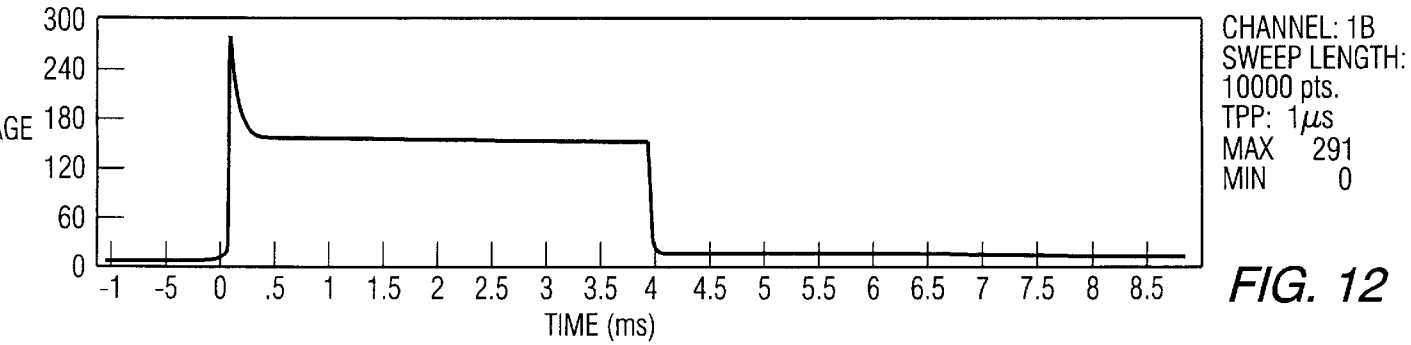
Figure 13:
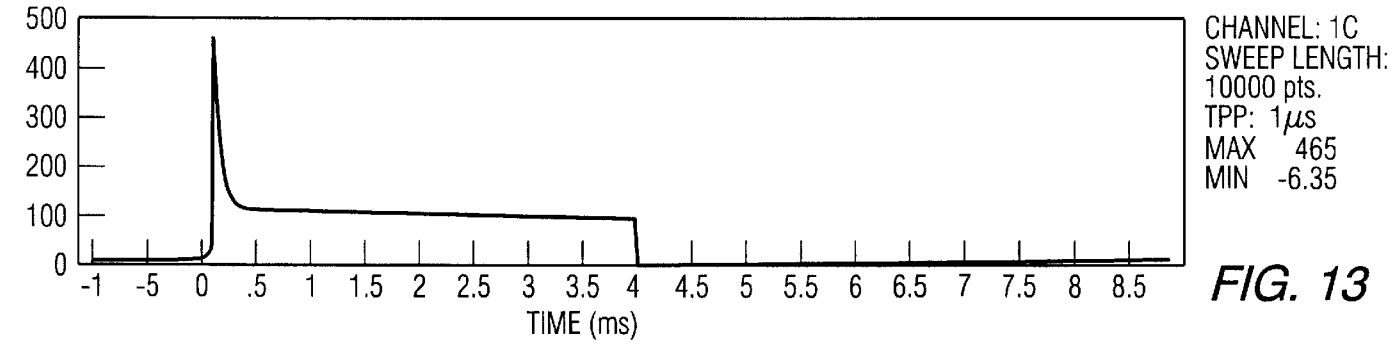

The fuse was tested with a capacitor bank designed to generate a 12 cycle of 60 Hz current. The capacitor bank voltage was set to supply 20 $kA_p$ current pulse for a period of 4 ms. The fuse resistance measured prior to testily was 2.97 mΩ. Upon exposure to the test current, the fuse transitioned to a high resistance state at 1.79 $kA_p$ in 150 μs and maintained voltaic hold-off for the entire test time of 4 ms with a let-through energy of 2,250 $A^2s$. The voltage measured across the fuse at the instant of switching was 289 $V_p$. The results of the test performed on the fuse are presented in FIGS. 11, 12 and 13. FIGS. 11, 12 and 13 depict the current, voltage and power waveforms exhibited by the fuse during the test. Because the polymer fuse reacts so fast (150 μs) the peak let-through current and let-through energy are extremely low. Without the polymer fuse, the peak current would reach about 20,000A after 4 ms. This represents a significant enhancement of the protection level.

The upper limit of the peak voltage has not yet been determined, but is believed to be dependant upon the pressure applied to the body of metal filed elastomer. Particularly, it is believed that lower pressures will result in slightly higher holdoff voltages. That is, the holdoff voltage is believed to be inversely related to the pressure exerted upon the body of metal filed elastomer.

The following claims represent the scope of this invention to the extent that it is subject to such delimitations. It will be appreciated by those skilled in the art that the anticipated uses and embodiments of the present invention are not amenable to precise delineation, but may vary from the exact language of the claims. Thus, the following claims are drawn not only to the explicit limitations, but also to the implicit embodiments embraced by the spirit of the claims.

We claim:

1. A current limiting fuse, comprising:

a body of an electrically conductive, PTC composition, wherein the body defines two substantially parallel surfaces;

a plurality of electrodes for carrying current through the body, wherein at least one of the plurality of electrodes is in free contact with one of the parallel surfaces;

a commutation shunt;

a pressure mechanism which maintains a force perpendicular to the parallel surfaces which force presses the electrodes against the substantially parallel surfaces, wherein the fuse exhibits let through values of less than 5,000 $A^2s$ with a switch current of 1.79 $kA_p$;

wherein the pressure mechanism comprises:

a cylindrical tube with two open ends, wherein the body is disposed within the cylindrical tube with the parallel surfaces facing the open ends of the tube;

wherein the plurality of electrodes comprise two threaded copper electrodes each having a silver plated surface for contacting the body; and wherein the cylindrical tube has groves adjacent the two open ends for threadably engaging the two threaded copper electrodes whereby the two threaded copper electrodes may be threaded into the cylindrical tube and brought to bear against the body.

2. The fuse of claim 1, wherein the pressure mechanism is provided with elastic pressure-exerting elements.

3. The fuse of claim 2, wherein the pressure-exerting elements comprise an electrically conductive spring and a moving electrode arranged within the cylindrical tube with the spring and the moving electrode interposed between and in electrical contact with the body and one of the threaded copper electrodes, wherein the spring is interposed between the moving electrode and the one of the threaded copper electrodes.

4. The fuse of claim 2, wherein the pressure-exerting elements comprise a spring, a moving electrode and a flex conductor arranged within the cylindrical tube with the spring and the moving electrode interposed between the body and one of the threaded copper electrodes, wherein the spring is interposed between the moving electrode and the one of the threaded copper electrodes, and wherein the flex conductor is in electrical contact with both the moving electrode and the one of the threaded copper electrodes and the moving electrode is in electrical contact with the body.

5. The fuse of claim 2, wherein the pressure-exiting elements comprise a rubber mass, a moving electrode and a flex conductor arranged within the cylindrical tube with the rubber mass and the moving electrode interposed between the body and one of the threaded copper electrodes, wherein the rubber mass is interposed between the moving electrode and the one of the threaded copper electrodes, and wherein the flex conductor is in electrical contact with both the moving electrode and the one of the threaded copper electrodes and the moving electrode is in electrical contact with the body.

* * * * *